United States Patent [19]

Carter

[11] 4,092,027

[45] May 30, 1978

[54] GOLF PRACTICE DEVICE

[76] Inventor: Lee T. Carter, 9224 Greenback La., Orangevale, Calif. 95662

[21] Appl. No.: 723,132

[22] Filed: Sep. 14, 1976

[51] Int. Cl.[2] ..... A63B 69/36

[52] U.S. Cl. ..... 273/195 R; 273/198; 273/35 B; 273/176 H; 273/200 R

[58] Field of Search ..... 273/200 R, 200 A, 200 B, 273/176 J, 198, 195 R, 35 B, 176 H, 195 A, 195 B, 196, 197 R, 197 A

[56] References Cited

U.S. PATENT DOCUMENTS

| | | | |
|---|---|---|---|
| 1,528,909 | 3/1925 | Bullard | 273/200 R X |
| 2,213,570 | 9/1940 | Rohland | 273/200 B |
| 3,473,811 | 10/1969 | Lees | 273/195 R |
| 3,826,439 | 7/1974 | Moon | 273/200 R X |

*Primary Examiner*—George J. Marlo
*Attorney, Agent, or Firm*—Blair & Brown

[57] ABSTRACT

A portable practice golf driving range including a tethered golf ball which is driven from an area of artificial turf. The tethering is of nylon cord which is connected to a spring steel spike driven into the ground, the spring steel being of sufficient resiliency that the ball will not be torn free from the nylon cord. Tension on the artificial turf may be adjusted to alter the characteristic lie of the golf ball when it is being driven.

4 Claims, 4 Drawing Figures

10
11
12
13
14
15
16
3

FIG. 3.
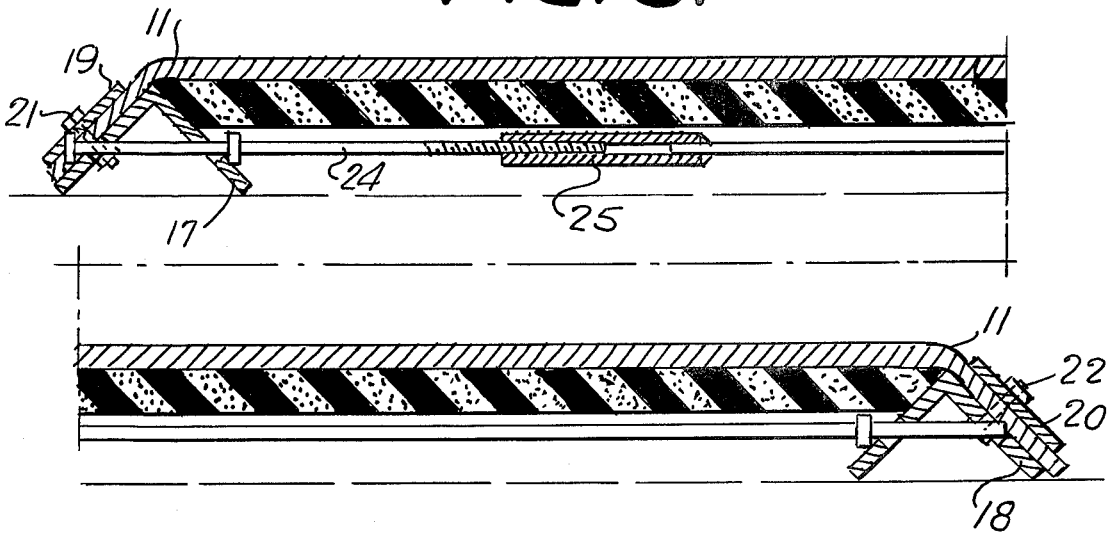
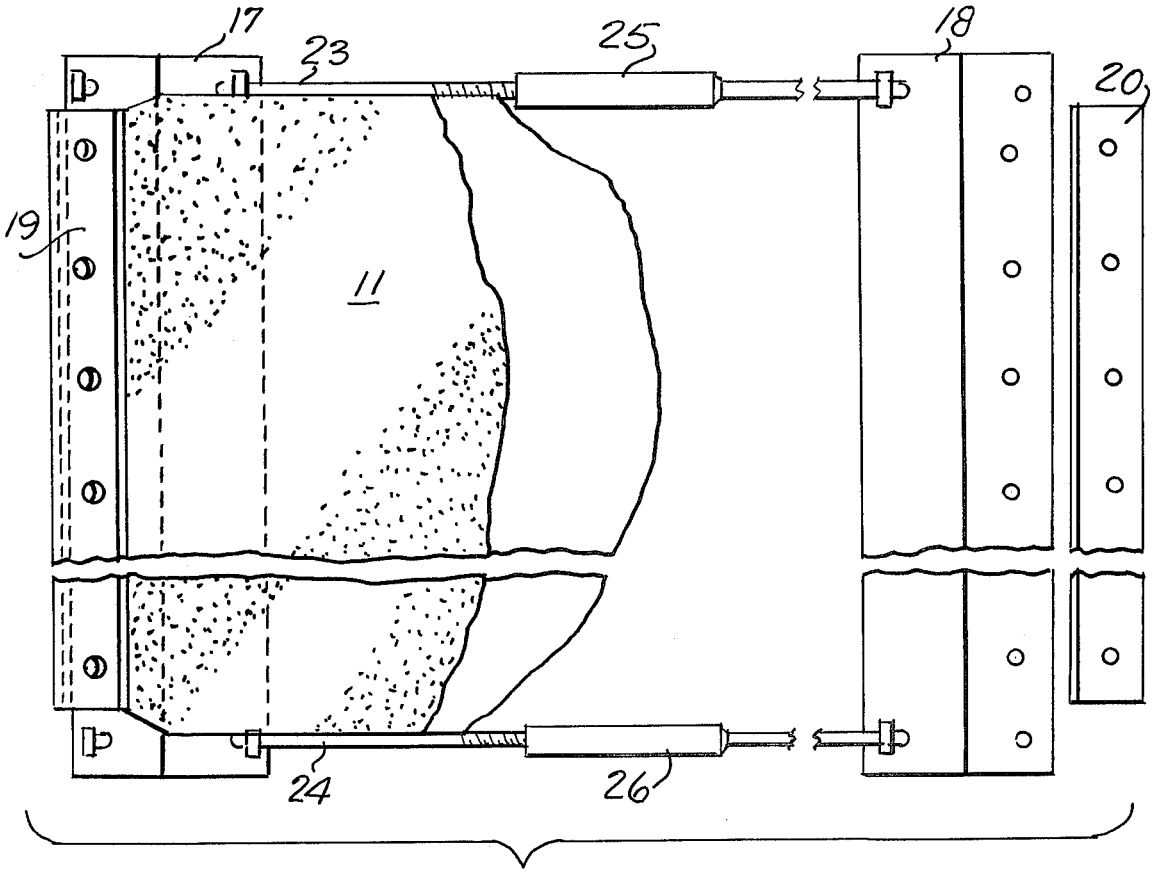
FIG. 4.

GOLF PRACTICE DEVICE

The skill of driving a golf ball presents a never-ending challenge for improvement. The cost of countless balls when used on a public driving range continually increases and the balls are quickly disposed of through many and rapid drives.

A device which a player can use over and over without further cost, and which is portable and useable at home or elsewhere, is highly attractive and desireable.

FIELD OF THE INVENTION

The present invention relates to a portable practice golf driving range.

SUMMARY OF THE INVENTION

The present invention of a portable practice golf driving range includes a length of nylon cord to be used as a tethering cord for a simulated regulation golf ball. One end of the cord is securely fastened to the practice ball and the other end to a spring steel spike driven into the ground. The length of the cord may be variable, according to the hitting strength of the player, and the spring steel spike is resilient enough to prevent the ball from being torn from the cord. The driving surface for the ball is simulated, artificial turf which is stretched between metallic angle iron terminals at each end of the driving strip, and adjustable means is provided for altering the tension of the turf strip between these terminals and thereby vary the simulated lie of the golf ball when it is being driven.

The primary object of the invention is to provide a portable practice golf driving range that may be located where desired and which provides practice conditions near enough to the real game of golf to enable a player added skill in the driving part of the game.

Other objects and advantages will become apparent in the following specification when considered in light of the attached drawings.

BRIEF DESCRIPTION OF THE DRAWINGS

FIG. 3 is a view taken along the lines 3—3 of FIG. 1 looking in the direction of the arrows and showing how tension on the turf is adjusted; and FIG. 4 is a top plan view of the turf, with a portion cut away.

DESCRIPTION OF THE PREFERRED EMBODIMENT

Figures 1, 2:
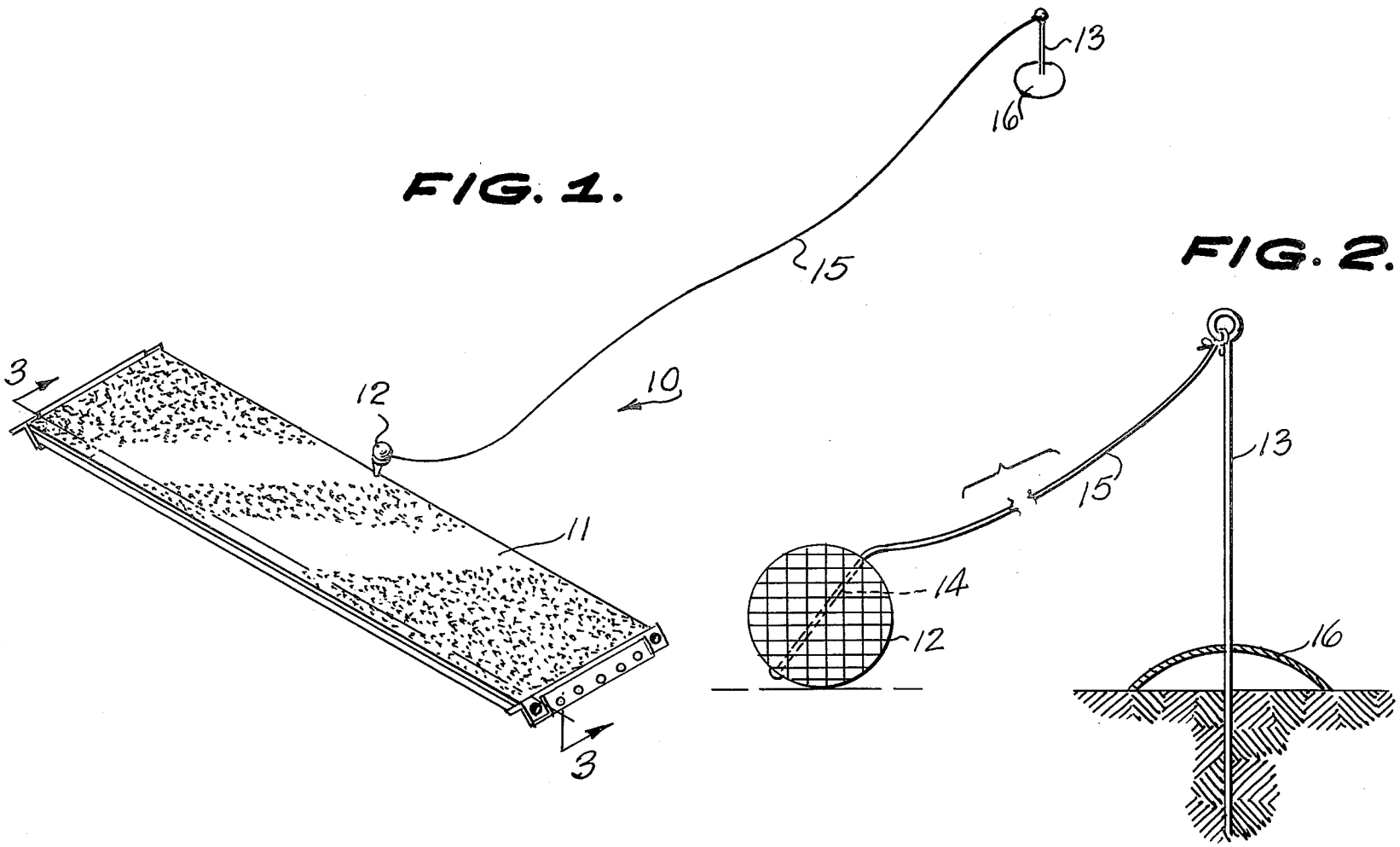
FIG. 1 is a perspective view showing the complete invention.
FIG. 2 is an elevation view showing the steel anchoring spike and the tethered ball.

Referring now to the drawings in detail, wherein like reference characters indicate like parts throughout the several figures, the reference numeral 10 indicates generally the overall practice set, including a simulated turf driving strip 11, a golf ball 12, and an anchoring spike 13.

The golf ball 12, which may be a regulation ball, has a hole 14 drilled through it, along its diameter, so that it will be equally balanced during flight. Attached to the ball 12 there is a long nylon cord 15 which is threaded through hole 14 and securely knotted to ball 12 so that it will not pull out. The length of nylon cord 15 is not important, but it can be varied depending upon the hitting strength and proficiency of the driver. A suggested length should be between 10 feet and 50 feet.

Anchoring spike 13 serves as the outer terminal for nylon cord 15, the spike 13 being of spring steel and being pushed firmly into the ground. A dome-shaped member 16 encircles spike 13 at ground level and not only adds beauty and finish to the spike, but it also gives support to the spike where it is pushed into the ground.

The actual driving area 11 is made of a strip of artificial, or simulated, turf in the order of 12 to 18 inches wide and 40 to 48 inches long. At each end of the strip there is an inverted angle iron 17, 18, with the turf 11 securely fastened to irons 17 and 18 by means of a metal plate 19, 20 overlaying turf 11 and being securely bolted to the angle irons by means of bolts 21, 22.

Joining the angle irons 17 and 18 there are two rods 23 and 24, placed along the sides of the turf strip, the rods 23 and 24 being anchored at their extremities into the angle irons 17 and 18 and forming part of them.

About midway the length of rods 23 and 24 there is a turnbuckle type arrangement 25 and 26 that is internally threaded to receive the two separate ends of the respective rods. With this arrangement it should be obvious that when the turnbuckle is rotated it will either draw in, or extend, the ends of the rods to thereby effectively shorten or lengthen the overall measurement of the rods. By this changing of the length of the rods 23 and 24, it can be seen that the length of turf strip 11 may thereby be adjusted to alter the tension on this turf between angles 17 and 18.

In the use and operation of the invention a length of nylon cord 15 is securely attached to a regulation golf ball 12, and to a spring steel spike 13 which is inserted in the ground, through the dome shaped member 16. The ball 12 may then be placed on a tee, placed on the strip of artificial turf 11, and the ball driven at this point.

Should the person using the invention wish to change slightly the characteristic feel of the turf strip 11, then turnbuckles 25 and 26 are rotated slightly to move the angled end mounts 17 and 18 and thereby alter the tension of the turf strip 11. This, plus the use of ball 12 without a tee on the turf, gives the feel of a fairway drive.

As mentioned previously, the length of the nylon cord may be varied according to whether the driver is a hard hitter or not. The cord will naturally stretch, and the anchor spike is made of spring steel to flex, but it is undesirable for the cord to be so short that the momentum of the ball will cause it to break free.

Having thus described the preferred embodiment of the invention it should be understood that numerous structural modifications and adaptations may be resorted to without departing from the spirit of the invention.

What is claimed is:

1. A practice golf driving range comprising a driving area, a golf ball, a stretchable cord attached at one end to the ball, and a metal spike for attachment to the other end of the cord, said driving area including an artificial turf surface, a pair of inverted, parallel angle irons supporting said surface at opposed extremities of said surface having tensioning means separating said angle irons further including parallel rods connecting said angle irons at their extremities having threaded medial portions with turnbuckles which serve to lengthen said rods.

2. The device of claim 1 wherein the stretchable cord is nylon.

3. The device of claim 2 wherein the metal spike is made of spring steel and further includes a dome shaped cover which overlies a portion of said metal spike which is inserted into the ground to provide a tether.

4. The device of claim 3 including a channel through the golf ball for passage and attachment of the nylon cord.

* * * * *